US008114220B2

(12) United States Patent
Visintin et al.

(10) Patent No.: US 8,114,220 B2
(45) Date of Patent: Feb. 14, 2012

(54) FORMULATIONS FOR CLEANING ION-IMPLANTED PHOTORESIST LAYERS FROM MICROELECTRONIC DEVICES

(75) Inventors: Pamela M. Visintin, Red Hook, NY (US); Michael B. Korzenski, Danbury, CT (US); Thomas H. Baum, New Fairfield, CT (US)

(73) Assignee: Advanced Technology Materials, Inc., Danbury, CT (US)

( * ) Notice: Subject to any disclaimer, the term of this patent is extended or adjusted under 35 U.S.C. 154(b) by 599 days.

(21) Appl. No.: 11/911,616

(22) PCT Filed: Apr. 14, 2006

(86) PCT No.: PCT/US2006/014407

§ 371 (c)(1),
(2), (4) Date: Oct. 15, 2007

(87) PCT Pub. No.: WO2006/113621

PCT Pub. Date: Oct. 26, 2006

(65) Prior Publication Data

US 2008/0269096 A1 Oct. 30, 2008

Related U.S. Application Data

(60) Provisional application No. 60/672,157, filed on Apr. 15, 2005.

(51) Int. Cl.

| | |
|---|---|
| ***B08B 3/04*** | (2006.01) |
| ***C11D 1/00*** | (2006.01) |
| ***C11D 3/28*** | (2006.01) |
| ***C11D 3/26*** | (2006.01) |

(52) U.S. Cl. ..... 134/1.2; 134/1.3; 510/175; 510/176; 510/245; 510/255; 510/258; 510/264; 510/477; 510/488; 510/499; 510/500; 510/504; 510/505; 510/506

(58) Field of Classification Search ..... 510/175, 510/176, 245, 254, 255, 258, 264, 477, 488, 510/499, 500, 505, 506; 134/1.2, 1.3
See application file for complete search history.

(56) References Cited

U.S. PATENT DOCUMENTS 6,149,828 A 11/2000 Vaartstra
(Continued)

FOREIGN PATENT DOCUMENTS

WO 2003097550 A1 11/2003
(Continued)

OTHER PUBLICATIONS

Intellectual Property Office of Singapore, Australian Patent Office Search Report, Dec. 16, 2008.

*Primary Examiner* — Gregory Delcotto
(74) *Attorney, Agent, or Firm* — Tristan A. Fuierer; Moore & Van Allen, PLLC; Rosa Yaghmour

(57) ABSTRACT

A method and composition for removing bulk and ion-implanted photoresist and/or post-etch residue material from densely patterned microelectronic devices is described. The composition includes a co-solvent, a chelating agent, optionally an ion pairing reagent, and optionally a surfactant. The composition may further include dense fluid. The compositions effectively remove the photoresist and/or post-etch residue material from the microelectronic device without substantially over-etching the underlying silicon-containing layer(s) and metallic interconnect materials.

15 Claims, 3 Drawing Sheets

U.S. PATENT DOCUMENTS

| | | | | |
|---|---|---|---|---|
| 6,500,605 | B1 | 12/2002 | Mullee et al. | |
| 6,596,093 | B2 | 7/2003 | DeYoung et al. | |
| 6,602,351 | B2 | 8/2003 | DeYoung et al. | |
| 6,613,157 | B2 | 9/2003 | DeYoung et al. | |
| 6,641,678 | B2 | 11/2003 | DeYoung et al. | |
| 6,735,978 | B1 * | 5/2004 | Tom et al. | 62/606 |
| 6,749,902 | B2 | 6/2004 | Yonker et al. | |
| 6,756,084 | B2 | 6/2004 | Fulton et al. | |
| 6,764,552 | B1 | 7/2004 | Joyce et al. | |
| 6,780,475 | B2 | 8/2004 | Fulton et al. | |
| 6,905,556 | B1 | 6/2005 | Humayun et al. | |
| 6,943,139 | B2 * | 9/2005 | Korzenski et al. | 510/176 |
| 6,989,358 | B2 * | 1/2006 | Korzenski et al. | 510/176 |
| 7,119,052 | B2 * | 10/2006 | Korzenski et al. | 510/175 |
| 7,160,815 | B2 * | 1/2007 | Korzenski et al. | 438/753 |
| 7,223,352 | B2 * | 5/2007 | Korzenski et al. | 252/79.1 |
| 7,517,809 | B2 * | 4/2009 | Korzenski et al. | 438/745 |
| 7,553,803 | B2 * | 6/2009 | Korzenski et al. | 510/175 |
| 2003/0066542 | A1 | 4/2003 | Riggs et al. | |
| 2003/0125225 | A1 | 7/2003 | Xu et al. | |
| 2003/0130146 | A1 * | 7/2003 | Egbe et al. | 510/175 |
| 2004/0045588 | A1 | 3/2004 | DeYoung et al. | |
| 2004/0067860 | A1 | 4/2004 | Lee | |
| 2004/0198622 | A1 | 10/2004 | Korzenski et al. | |
| 2004/0224865 | A1 | 11/2004 | Roeder et al. | |
| 2005/0118832 | A1 | 6/2005 | Korzenski et al. | |
| 2005/0192193 | A1 | 9/2005 | Korzenski et al. | |
| 2005/0227482 | A1 | 10/2005 | Korzenski et al. | |
| 2006/0000150 | A1 * | 1/2006 | Kelley et al. | 51/298 |

FOREIGN PATENT DOCUMENTS

| | | | |
|---|---|---|---|
| WO | 2004042472 | A2 | 5/2004 |

* cited by examiner

FORMULATIONS FOR CLEANING ION-IMPLANTED PHOTORESIST LAYERS FROM MICROELECTRONIC DEVICES

CROSS-REFERENCE TO RELATED APPLICATIONS

This application is filed under the provisions of 35U.S.C. §371 and claims the priority of International Patent Application No. PCT/US2006/014407 filed on 14 Apr. 2006, which claims priority to U.S. Provisional Patent Application No. 60/672,157 filed on 15 Apr. 2005, which are both hereby incorporated herein in their entireties.

FIELD OF THE INVENTION

The present invention relates to compositions useful for the removal of bulk and ion-implanted photoresist and/or post-etch residue from the surface of microelectronic devices, and methods of using said compositions for removal of same.

DESCRIPTION OF THE RELATED ART

As semiconductor devices has become more integrated and miniaturized, ion implantation has been extensively employed during front-end-of-line (FEOL) processing to accurately control impurity distributions in the microelectronic device and to add dopant atoms, e.g., As, B, P, In and Sb, to the exposed device layers. The concentration and depth of the dopant impurity is controlled by varying the dose of the dopant, the acceleration energy, and the ion current. Prior to subsequent processing, the ion-implanted photoresist layer must be removed. Various processes have been used in the past for the removal of said resist including, but not limited to, wet chemical etching processes, e.g., in a mixed solution of sulphuric acid and hydrogen peroxide, and dry plasma etching processes, e.g., in an oxygen plasma ashing process.

Unfortunately, when high doses of ions (e.g., doses greater than about $1\times10^{15}$ ions/cm$^2$) are implanted in the desired layer, they are also implanted throughout the photoresist layer, particularly the exposed surface of the photoresist, which becomes physically and chemically rigid. The rigid ion-implanted photoresist layer, also referred to as the carbonized region or "crust," has proven difficult to remove.

As such, additional, complicated, time consuming and costly processes have been required to remove the ion-implanted photoresist layer because of the resulting low hydrogen concentration of the carbonized region.

Presently, the removal of the ion-implanted photoresist and other contaminants is usually performed by a plasma etch method followed by a multi-step wet strip process, typically using aqueous-based etchant formulations to remove photoresist, post-etch residue and other contaminants. Wet strip treatments in the art generally involve the use of strong acids, bases, solvents, and oxidizing agents. Disadvantageously, however, wet strip treatments also etch the underlying silicon-containing layers, such as the substrate and gate oxide, and/or increase the gate oxide thickness.

As the feature sizes continue to decrease, satisfying the above cleaning requirements becomes significantly more challenging using the aqueous-based etchant formulations of the prior art. Water has a high surface tension which limits or prevents access to the smaller image nodes with high aspect ratios, and therefore, removing the residues in the crevices or grooves becomes more difficult. In addition, aqueous-based etchant formulations often leave previously dissolved solutes behind in the trenches or vias upon evaporative drying, which inhibits conduction and reduces device yield. Furthermore, underlying porous low-k dielectric materials do not have sufficient mechanical strength to withstand the capillary stress of high surface tension liquids such as water, resulting in pattern collapse of the structures. Aqueous etchant formulations can also strongly alter important material properties of the low-k materials, including dielectric constant, mechanical strength, moisture uptake, coefficient of thermal expansion, and adhesion to different substrates. Dense fluids, including supercritical fluids (SCF), provide an alternative method for removing bulk and ion-implanted photoresist and/or post-etch residue from the microelectronic device. SCFs diffuse rapidly, have low viscosity, near zero surface tension, and can penetrate easily into deep trenches and vias. Further, because of their low viscosity, SCFs can rapidly transport dissolved species. However, SCFs are highly non-polar and as such, many species are not adequately solubilized therein.

Recently, supercritical carbon dioxide ($SCCO_2$) compositions containing co-solvents have been used to enhance bulk photoresist and ion-implanted resist removal from $Si/SiO_2$ regions of both blanketed and patterned wafers. However, compositions containing only $SCCO_2$ and co-solvents have proven to be incapable of removing 100% of the ion-implanted resist from the wafer surface.

Towards that end, additional components must be added to the $SCCO_2$ composition to enhance the removal capacity of said composition for the ion-implanted resist. Importantly, the overall composition must efficiently remove ion-implanted resist from a densely patterned surface while not substantially over-etching the underlying $Si/SiO_2$ layer (i.e., gate oxides (e.g., thermally or chemically grown $SiO_2$), low-k dielectrics, and the underlying silicon-containing substrate). Co-extensive with the decrease in feature sizes, the depth of the underlying silicon-containing layer has also decreased, and is rapidly approaching about 1 nm in thickness. In other words, the loss of greater than one Angstrom of said underlying silicon-containing layer is a substantial (greater than 10%), and unacceptable, over-etch of the underlying surface.

Fluoride ions from various sources, e.g., ammonium fluoride, triethylamine trihydrofluoride, hydrofluoric acid, etc., are known to effectively remove ion-implanted photoresist, however, fluoride ions also increase the etch rates of solutions towards silicon-containing materials. Therefore, when fluoride ions are present in the removal composition, additional species are preferably present to substantially inhibit etching of the underlying silicon-containing materials.

It would therefore be a significant advance in the art to provide an improved composition that overcomes the deficiencies of the prior art relating to the removal of ion-implanted photoresist from microelectronic devices. The improved composition is useful as a liquid or in a dense fluid phase. The improved composition shall effectively remove bulk and ion-implanted photoresist and/or post-etch residue without substantially over-etching the underlying silicon-containing layer(s).

SUMMARY OF THE INVENTION

The present invention relates to compositions useful for the removal of bulk and ion-implanted photoresist and/or post-etch residue from the surface of densely patterned microelectronic devices, and methods of using said compositions for removal of same.

In one aspect, the invention relates to a removal composition, comprising at least one co-solvent, at least one chelating agent, optionally at least one ion pairing agent, and optionally at least one surfactant, wherein said removal composition is suitable for removing bulk and ion-implanted photoresist and/or post-etch residue material from a microelectronic device having said material thereon. In a preferred embodiment, the removal composition further includes a dense fluid.

In yet another aspect, the invention relates to a kit comprising, in one or more containers, removal composition reagents, wherein the removal composition comprises at least one co-solvent, at least one chelating agent, optionally at least one ion pairing reagent, and optionally at least one surfactant, and wherein the kit is adapted to form a removal composition suitable for removing bulk and ion-implanted photoresist and/or post-etch residue material from a microelectronic device having said material thereon.

In a further aspect, the invention relates to a method of removing bulk and ion-implanted photoresist and/or post-etch residue material from a microelectronic device having said material thereon, said method comprising contacting the microelectronic device with a removal composition for sufficient time to at least partially remove said material from the microelectronic device, wherein the removal composition includes at least one co-solvent, at least one chelating agent, optionally at least one ion pairing agent, and optionally at least one surfactant. In a preferred embodiment, the removal composition further includes a dense fluid.

In another aspect, the present invention relates to a method of removing bulk and ion-implanted photoresist and/or post-etch residue material from a microelectronic device having said material thereon, said method comprising contacting the microelectronic device with an removal composition for sufficient time to at least partially remove said material from the microelectronic device, wherein said removal composition comprises at least one removal concentrate and at least one dense fluid and said removal concentrate comprises at least one co-solvent, at least one chelating agent, optionally at least one ion pairing agent, and optionally at least one surfactant.

In yet another aspect, the present invention relates to a method of manufacturing a microelectronic device, said method comprising contacting the microelectronic device with a removal composition for sufficient time to at least partially remove bulk and ion-implanted photoresist and/or post-etch residue material from the microelectronic device having said material thereon, wherein the removal composition includes at least one co-solvent, at least one chelating agent, optionally at least one ion pairing agent, and optionally at least one surfactant. In a preferred embodiment, the removal composition further includes a dense fluid.

Other aspects, features and embodiments of the invention will be more fully apparent from the ensuing disclosure and appended claims.

DETAILED DESCRIPTION OF THE INVENTION, AND PREFERRED EMBODIMENTS THEREOF

Figure 1:
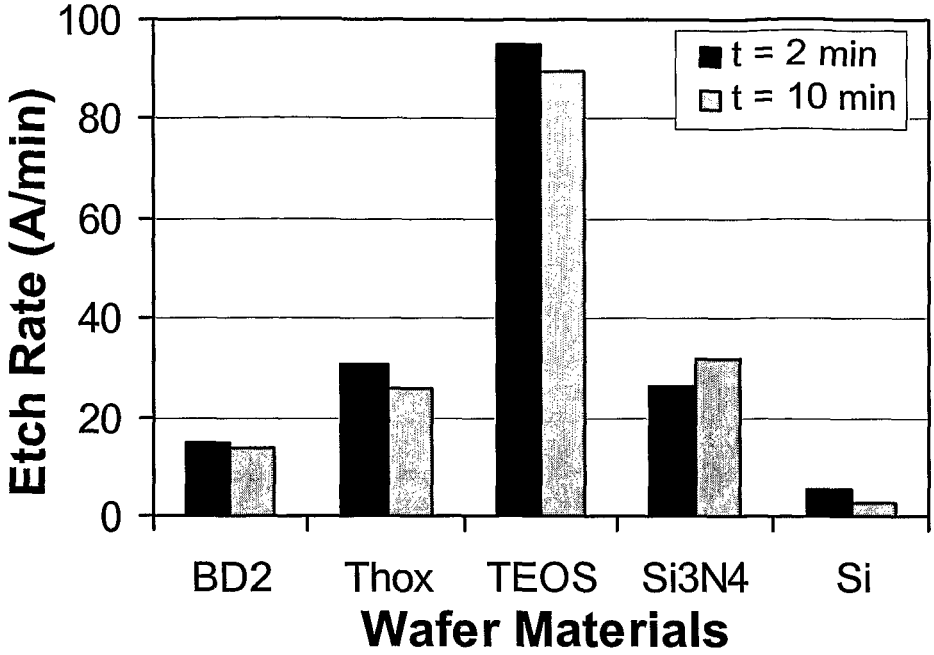
FIG. 1 is an illustration of the selectivity of TEOS relative to Black Diamond 2 (BD2), thermal oxide (Thox), $Si_3N_4$ and polysilicon, following immersion of each in a 1 w/v % pyridine/HF (1:1) in methanol composition at 50° C.

The present invention is based on the discovery of compositions that are highly efficacious for the removal of bulk and ion-implanted photoresist and/or post-etch residue from the surface of densely patterned microelectronic devices, while maintaining the integrity of the underlying silicon-containing layer(s). Specifically, the present invention relates to liquid and dense fluid compositions that selectively remove ion-implanted photoresist relative to the underlying $Si/SiO_2$ layers.

"Bulk photoresist," as used herein, corresponds to the non-carbonized photoresist on the microelectronic device surface, specifically below and/or adjacent to the ion-implanted photoresist crust.

"Densely patterned," as defined herein, corresponds to the line and space dimensions and narrow source/drain regions photolithographically produced in the photoresist. Preferably, a densely patterned microelectronic device corresponds to one having sub 100 nm features, preferably less than 50 nm features, e.g., 32 nm. Densely patterned microelectronic devices are more difficult to clean than blanketed or non-densely patterned photoresist because there is more photoresist crust to remove, i.e., a higher surface area because the ion implantation crust forms on the top and the sidewalls of the photoresist, and cleaning in the smaller lines and holes is more challenging.

As used herein, "underlying silicon-containing" layer corresponds to the layer(s) underlying the bulk and/or the ion-implanted photoresist including: silicon; silicon oxide; silicon nitride; gate oxides (e.g., thermally or chemically grown $SiO_2$); hard mask; and low-k silicon-containing materials. As defined herein, "low-k silicon-containing material" corresponds to any material used as a dielectric material in a layered microelectronic device, wherein the material has a dielectric constant less than about 3.5. Preferably, the low-k dielectric materials include low-polarity materials such as silicon-containing organic polymers, silicon-containing hybrid organic/inorganic materials, organosilicate glass (OSG), TEOS, fluorinated silicate glass (FSG), silicon dioxide, and carbon-doped oxide (CDO) glass. It is to be appreciated that the low-k dielectric materials may have varying densities and varying porosities.

"Microelectronic device" corresponds to semiconductor substrates, flat panel displays, and microelectromechanical systems (MEMS), manufactured for use in microelectronic, integrated circuit, or computer chip applications. It is to be understood that the term "microelectronic device" is not meant to be limiting in any way and includes any substrate that will eventually become a microelectronic device or microelectronic assembly.

"Dense fluid," as used herein, corresponds to a supercritical fluid or a subcritical fluid. The term "supercritical fluid" is used herein to denote a material which is under conditions of not lower than a critical temperature, $T_c$, and not less than a critical pressure, $P_c$, in a pressure-temperature diagram of an intended compound. The preferred supercritical fluid employed in the present invention is $CO_2$, which may be used alone or in an admixture with another additive such as Ar, $NH_3$, $N_2$, $CH_4$, $C_2H_4$, $CHF_3$, $C_2H_6$, n-$C_3H_8$, $H_2O$, $N_2O$ and the like. The term "subcritical fluid" describes a solvent in the subcritical state, i.e., below the critical temperature and/or below the critical pressure associated with that particular solvent. Preferably, the subcritical fluid is a high pressure liquid of varying density.

As defined herein, "substantially over-etching" corresponds to greater than about 10% removal, more preferably greater than about 5% removal, and most preferably greater than about 2% removal, of the adjacent underlying silicon-containing layer(s) following contact, according to the process of the invention, of the removal composition of the invention with the microelectronic device having said underlying layers.

As defined herein, "post-etch residue" corresponds to material remaining following gas-phase plasma etching processes, e.g., BEOL dual damascene processing. The post-etch residue may be organic, organometallic, organosilicic, or inorganic in nature, for example, silicon-containing material, carbon-based organic material, and etch gas residue including, but not limited to, oxygen and fluorine.

As used herein, "about" is intended to correspond to ±5% of the stated value.

As used herein, "suitability" for removing bulk and ion-implanted photoresist and/or post-etch residue material from a microelectronic device having said material thereon corresponds to at least partial removal of said material from the microelectronic device. Preferably, at least 90% of the material is removed from the microelectronic device using the compositions of the invention, more preferably at least 95% of the material, and most preferably at least 99% of the material, is removed.

Importantly, the dense fluid compositions of the present invention must possess good metal compatibility, e.g., a low etch rate on the metal. Metals of interest include, but are not limited to, copper, tungsten, cobalt, aluminum, tantalum, titanium and ruthenium.

Because of its readily manufactured character and its lack of toxicity and negligible environmental effects, supercritical carbon dioxide ($SCCO_2$) is the preferred phase in the broad practice of the present invention. $SCCO_2$ is an attractive reagent for removal of microelectronic device process contaminants, since $SCCO_2$ has the characteristics of both a liquid and a gas. Like a gas, it diffuses rapidly, has low viscosity, near-zero surface tension, and penetrates easily into deep trenches and vias. Like a liquid, it has bulk flow capability as a "wash" medium. $SCCO_2$ has a density comparable to organic solvents and also has the advantage of being recyclable, thus minimizing waste storage and disposal requirements.

Ostensibly, $SCCO_2$ is an attractive reagent for the removal of bulk negative and positive tone resists, contrast enhancement layers (CEL), anti-reflective coatings (ARC) and ion-implanted photoresist, because all are organic in nature. However, neat $SCCO_2$ has not proven to be a sufficiently effective medium for solubilizing said materials. Furthermore, the addition of a polar co-solvent alone, e.g., alcohols, to the $SCCO_2$ has not substantially improved the solubility of the materials in the $SCCO_2$ composition. Accordingly, there is a continuing need to modify the $SCCO_2$ composition to enhance the removal of ion-implanted photoresist and other materials from the microelectronic device surface.

The present invention overcomes the disadvantages associated with the non-polarity of $SCCO_2$ by appropriate formulation of removal compositions including $SCCO_2$ and other additives as hereinafter more fully described, and the accompanying discovery that removing bulk and ion-implanted photoresist and/or post-etch residue from densely patterned microelectronic devices with said removal medium is highly effective and does not substantially over-etch the underlying silicon-containing layer(s) and metallic interconnect materials.

Compositions of the invention may be embodied in a wide variety of specific formulations, as hereinafter more fully described.

In all such compositions, wherein specific components of the composition are discussed in reference to weight percentage ranges including a zero lower limit, it will be understood that such components may be present or absent in various specific embodiments of the composition, and that in instances where such components are present, they may be present at concentrations as low as 0.01 weight percent, based on the total weight of the composition in which such components are employed.

In one aspect, the invention relates to a liquid removal composition useful in removing bulk photoresist, ion-implanted resist, and/or post-etch residue material from a microelectronic device. The liquid removal composition according to one embodiment comprises at least one co-solvent, at least one chelating agent, optionally at least one ion-pairing reagent, and optionally at least one surfactant, present in the following ranges, based on the total weight of the composition:

| component of | % by weight |
|---|---|
| co-solvent | about 0.01% to about 99.5% |
| chelating agent | about 0.01% to about 20.0% |
| ion-pairing agent | 0% to about 20.0% |
| surfactant | 0% to about 20.0% |

In one aspect, the range of mole ratios of co-solvent(s) relative to chelating agent(s) in the liquid removal composition is about 10:1 to about 3500:1, more preferably about 100:1 to about 1000:1; the range of mole ratios of co-solvent(s) relative to surfactant(s) (when present) is about 300:1 to about 7000:1, more preferably about 300:1 to about 1000:1; and the range of mole ratios of co-solvent(s) relative to ion-pairing(s) (when present) is about 300:1 to about 7000:1, more preferably about 300:1 to about 1000:1.

In the broad practice of the invention, the liquid removal composition may comprise, consist of, or consist essentially of at least one co-solvent, at least one chelating agent, optionally at least one ion-pairing agent, and optionally at least one surfactant. In general, the specific proportions and amounts of co-solvent(s), chelating agent(s), optional ion-pairing agent(s), and optional surfactant(s), in relation to each other may be suitably varied to provide the desired removal action of the liquid removal composition for the bulk and ion-implanted photoresist, post-etch residue, and/or processing equipment, as readily determinable within the skill of the art without undue effort.

In another aspect, the invention relates to a dense fluid removal composition useful in removing bulk photoresist, ion-implanted resist, and/or post-etch residue material from a microelectronic device, wherein said dense fluid removal composition includes the liquid removal composition, i.e., concentrate, and dense $CO_2$, preferably $SCCO_2$, present in the following ranges, based on the total weight of the composition:

| component of | % by weight |
|---|---|
| dense $CO_2$ | about 45.0% to about 99.9% |
| liquid removal comp. | about 0.1% to about 55.0% |

preferably,

| component of | % by weight |
|---|---|
| dense $CO_2$ | about 85.0% to about 99% |
| liquid removal comp. | about 1% to about 15.0% |

In the broad practice of the invention, the dense fluid removal composition may comprise, consist of, or consist essentially of dense $CO_2$, at least one co-solvent, at least one chelating agent, optionally at least one ion-pairing agent, and optionally at least one surfactant. In general, the specific proportions and amounts of $SCCO_2$, co-solvent(s), chelating agent(s), optional ion-pairing agent(s), and optional surfactant(s), in relation to each other may be suitably varied to provide the desired removal action of the dense fluid removal composition for the bulk and ion-implanted photoresist, post-etch residue, and/or processing equipment, as readily determinable within the skill of the art without undue effort.

In one aspect, the range of mole ratios of liquid removal composition relative to $SCCO_2$ in the dense fluid removal composition is about 1:200 to about 1:4, more preferably about 1:100 to about 1:6.

Co-solvent species useful in the removal compositions of the invention may be of any suitable type, including alcohols, amides, ketones, esters, etc. Illustrative species include, but are not limited to, water, methanol, ethanol, isopropanol, and higher alcohols (including diols, triols, etc.), ethers, N-alkylpyrrolidones or N-arylpyrrolidones, such as N-methyl-, N-octyl-, or N-phenyl-pyrrolidones, sulfolane, ethyl acetate, alkanes (straight, branched or cyclic), alkenes (straight, branched or cyclic), highly fluorinated hydrocarbons (including perfluoro and mono-fluorinated compounds), amines, phenols, tetrahydrofuran, toluene, xylene, cyclohexane, acetone, dioxane, dimethyl formamide, dimethylsulfoxide (DMSO), pyridine, triethylamine, acetonitrile, glycols, butyl carbitol, methyl carbitol, hexyl carbitol, monoethanolamine, butyrol lactone, diglycol amine, tetramethylene sulfone, diethyl ether, ethyl lactate, ethyl benzoate, ethylene glycol, dioxane, pyridine, γ-butyrolactone, butylene carbonate, ethylene carbonate, and propylene carbonate and mixtures thereof. Methanol, water and DMSO are especially preferred.

Although not wishing to be bound by theory, it is assumed that the chelating agents in the removal compositions of the present invention break weak interfacial bonds between the underlying silicon-containing layer and the crust, as well as attack the crust itself. Specifically, the chelating agents form complexes with the dopant ions, i.e., As, B, and P, in the ion-implanted resist. Chelating agents useful in the compositions of the invention should not react with the dense fluid, e.g., $SCCO_2$, the co-solvent or the other reagents of the removal composition. The chelating agents are preferably soluble in the dense fluid and can be of any suitable type, including, for example, 1,1,1,5,5,5-hexafluoro-2,4-pentanedione (hfacH), 1,1,1-trifluoro-2,4-pentanedione (tfacH), 2,2,6,6-tetramethyl-3,5-heptanedione (tmhdH), acetylacetone (acacH), pyridine, 2-ethylpyridine, 2-methoxypyridine, 2-picoline, pyridine derivatives, piperidine, piperazine, triethanolamine, diglycol amine, monoethanolamine, pyrrole, isoxazole, 1,2,4-triazole, bipyridine, pyrimidine, pyrazine, pyridazine, quinoline, isoquinoline, indole, imidazole, triethylamine, ammonia, oxalate, acetic acid, formic acid, sulfuric acid, citric acid, phosphoric acid, butyl acetate, perfluorobutanesulfonyl fluoride, pyrrolidinecarbodithiolate, diethyldithiocarbamate, trifluoroethyl dithiocarbamate, trifluoromethanesulfonate, methanesulfonic acid, meso-2,3-dimercaptosuccinic acid, 2,3-dimercapto-1-propanesulfonic acid, 2,3-dimercapto-1-propanol, 2-methylthio-2-thiazoline, 1,3-dithiolane, sulfolane, perfluorodecanethiol, 1,4,7-trithiacyclononane, 1,4,8,11-tetrathiacyclotetradecane, 1,5,9,13-tetraselenacyclohexadecane, 1,5,9,13,17,21-hexaselenacyclotetracosane, iodine, bromine, chlorine, triphenylphosphine, diphenyl(pentafluorophenyl)phosphine, bis(pentafluorophenyl)phenylphosphine, tris(pentafluorophenyl)phosphine, tris(4-fluorophenyl)phosphine, 1,2-bis[bis(pentafluorophenyl)phosphino]ethane, 1,2-bis(diphenylphosphino)ethane, pyridine/HF complex, pyridine/HCl complex, pyridine/HBr complex, triethylamine/HF complex, triethylamine/HCl complex, monoethanolamine/HF complex, triethanolamine/HF complex, triethylamine/formic acid complex and combinations thereof. Preferably, the chelating agent is the pyridine/HF and/or triethylamine/HF complex.

Although not wishing to be bound by theory, it is assumed that the ion-pairing agents in the removal compositions of the present invention are attracted to and subsequently solubilize the dopant ion/chelating agent complexes. Illustrative ion pairing reagents include, but are not limited to, pyrrolidinecarbodithiolate salt, diethyldithiocarbamate salt, trifluoromethanesulfonate salt, trifluoroethyl dithiocarbamate salt, potassium iodide, potassium bromide, potassium chloride, cetyl tetramethylammonium sulfuric acid, cetyl tetramethylammonium bromide, hexadecylpyridinium chloride, tetrabutylammonium bromide, dioctylsulfosuccinate salt, and 2,3-dimercapto-1-propanesulfonic acid salt.

The removal compositions of the invention may further include a surfactant to assist in the removal of the resist from the surface of the microelectronic device. Illustrative surfactants include, but are not limited to, fluoroalkyl surfactants, ethoxylates of 2,4,7,9-Tetramethyl-5-decyne-4,7-diol (e.g., Surfynol® 104), alkyl aryl polyethers (e.g., Triton® CF-21), fluorosurfactants (e.g., Zonyl® UR), dioctylsulfosuccinate salt, 2,3-dimercapto-1-propanesulfonic acid salt, dodecylbenzenesulfonic acid, amphiphilic fluoropolymers, dinonylphenyl polyoxyethylene, silicone or modified silicone polymers, acetylenic diols or modified acetylenic diols, alkylammonium or modified alkylammonium salts, sodium dodecyl sulfate, aerosol-OT (AOT) and fluorinated analogues thereof, alkyl ammonium, perfluoropolyether surfactants, 2-sulfosuccinate salts, phosphate-based surfactants, sulfur-based surfactants, and acetoacetate based polymers. Preferably, the surfactant includes an acetylenic diol such as 2,4,7,9-tetramethyl-5-decyne-4,7-diol.

In general, the specific proportions and amounts of at least one co-solvent, at least one chelating agent, optionally at least one ion-pairing reagent, and optionally at least one surfactant, in relation to each other may be suitably varied to provide the desired solubilizing action of the liquid removal composition for the bulk and ion-implanted photoresist and/or post-etch residue to be removed from the microelectronic device. In addition, the specific proportions and amounts of the liquid removal composition, i.e., concentrate, and dense fluid in relation to each other may be suitably varied to provide the desired solubilizing action of the dense fluid removal composition for the bulk and ion-implanted photoresist and/or post-etch residue to be removed from the microelectronic device. Such specific proportions and amounts are readily determinable by simple experiment within the skill of the art without undue effort.

It is to be understood that the phrase "removing bulk and ion-implanted photoresist and/or post-etch residue material from a microelectronic device" is not meant to be limiting in any way and includes the removal of bulk and ion-implanted photoresist and/or post-etch residue material from any substrate that will eventually become a microelectronic device.

In a particularly preferred embodiment of the present invention, the formulation includes the following components present in the following ranges, based on the total weight of the composition:

| component of | % by weight |
|---|---|
| $SCCO_2$ | about 80.0% to about 99.89% |
| co-solvent(s) | about 0.1% to about 15.0% |
| chelating agent(s) | about 0.01% to about 5.0% |

Preferably, the dense fluid removal composition includes 98.95 wt. % $SCCO_2$, 1 wt. % methanol and 0.05 wt. % pyridine/HF complex (1:1 mole ratio).

In another particularly preferred embodiment, the liquid removal composition includes the following components present in the following ranges, based on the total weight of the composition:

| component of | % by weight |
|---|---|
| co-solvent(s) | about 90% to about 99% |
| chelating agent(s) | about 0.5% to about 8.0% |
| surfactant(s) | about 0.01% to about 4.0% |

The range of mole ratios of co-solvent(s) relative to chelating agent(s) in the liquid removal composition is about 10:1 to about 3500:1, more preferably about 300:1 to about 1500:1; the range of mole ratios of co-solvent(s) relative to surfactant(s) is about 300:1 to about 7000:1, more preferably about 300:1 to about 1000:1.

In the broad practice of the invention, the liquid removal composition may comprise, consist of, or consist essentially of at least one co-solvent, at least one chelating agent, at least one surfactant, and optionally at least one ion-pairing agent. In general, the specific proportions and amounts of co-solvent(s), chelating agent(s), surfactant(s), and optional ion-pairing agent(s) in relation to each other may be suitably varied to provide the desired removal action of the liquid removal composition for the bulk and ion-implanted photoresist, post-etch residue, and/or processing equipment, as readily determinable within the skill of the art without undue effort.

For example, the liquid removal composition may include methanol, pyridine, pyridine:HF, and at least one acetylenic diol surfactant, e.g., 2,4,7,9-tetramethyl-5-decyne-4,7-diol. It is to be appreciated by one skilled in the art that the liquid removal composition may be mixed with a dense fluid to formulate a dense fluid removal composition comprising dense fluid, co-solvent(s), chelating agent(s) and surfactant(s). For example, the liquid removal composition may be mixed with $SCCO_2$ to form a dense fluid removal composition.

The removal compositions of the invention may optionally be formulated with additional components to further enhance the removal capability of the composition, or to otherwise improve the character of the composition. Accordingly, the compositions may be formulated with stabilizers, complexing agents, passivators, e.g., Cu passivating agents, and/or corrosion inhibitors to improve metal compatibility.

In another aspect, the invention relates to a liquid removal composition comprising at least one co-solvent, at least one chelating agent, at least one ion-pairing reagent, and optionally at least one surfactant. In the broad practice of the invention, the liquid removal composition may comprise, consist of, or consist essentially of at least one co-solvent, at least one chelating agent, at least one ion-pairing reagent, and optionally at least one surfactant. It is to be appreciated by one skilled in the art that the liquid removal composition may be mixed with a dense fluid to formulate a dense fluid removal composition comprising dense fluid, co-solvent(s), chelating agent(s), ion-pairing reagent(s), and optional surfactant(s). For example, the liquid removal composition may be mixed with $SCCO_2$ to form a dense fluid removal composition.

In yet another preferred embodiment, the liquid removal composition of the present invention include at least one co-solvent, at least one chelating agent, optionally at least one ion-pairing reagent, optionally at least one surfactant, and residue material selected from the group consisting of bulk photoresist, ion-implanted photoresist, post-etch residue and combinations thereof. Importantly, the residue material may be dissolved and/or suspended in the liquid removal composition of the invention. Analogously, the liquid removal composition of the present invention may include at least one co-solvent, at least one chelating agent, optionally at least one ion-pairing reagent, optionally at least one surfactant, and at least one dopant ion selected from the group consisting of B, P, As, In and Sb, more preferably, at least one co-solvent, at least one surfactant, at least one chelating agent:dopant ion complex, and optionally at least one ion-pairing agent.

In still another preferred embodiment, the dense fluid removal composition of the present invention include a dense fluid, at least one co-solvent, at least one chelating agent, optionally at least one ion-pairing reagent, optionally at least one surfactant, and residue material selected from the group consisting of bulk photoresist, ion-implanted photoresist, post-etch residue and combinations thereof. Importantly, the residue material may be dissolved and/or suspended in the dense fluid removal composition of the invention. Analogously, the liquid removal composition of the present invention may include a dense fluid, at least one co-solvent, at least one chelating agent, optionally at least one ion-pairing reagent, optionally at least one surfactant, and at least one dopant ion selected from the group consisting of B, P, As, In and Sb, more preferably, a dense fluid, at least one co-solvent, at least one surfactant, at least one chelating agent:dopant ion complex, and optionally at least one ion-pairing agent.

The liquid removal compositions of the invention are readily formulated by simple mixing of the co-solvent(s), chelating agent(s), optional ion-pairing reagent(s), and optional surfactant(s), e.g., in a mixing vessel or the cleaning vessel under gentle agitation. The co-solvent(s), chelating agent(s), optional ion-pairing reagent(s), and optional surfactant(s) may be readily formulated as single-package formulations or multi-part formulations that are mixed at the point of use. The individual parts of the multi-part formulation may be mixed at the tool or in a storage tank upstream of the tool. The concentrations of the single-package formulations or the individual parts of the multi-part formulation may be widely varied in specific multiples, i.e., more dilute or more concentrated, in the broad practice of the invention, and it will be appreciated that the liquid removal compositions of the invention can variously and alternatively comprise, consist or consist essentially of any combination of ingredients consistent with the disclosure herein. The dense fluid removal compositions of the invention are readily formulated by static or dynamic mixing at the appropriate temperature and pressure.

Accordingly, another aspect of the invention relates to a kit including, in one or more containers, one or more components adapted to form the compositions of the invention. Preferably, the kit includes, in one or more containers, at least one co-solvent, at least one chelating agent, optionally at least one ion-pairing reagent, and optionally at least one surfactant for combination at the fab. According to another embodiment, the kit includes, in one or more containers, at least one chelating agent, optionally at least one ion-pairing reagent, and optionally at least one surfactant for combining with the at least one co-solvent at the fab. According to another embodiment, the kit includes, in one or more containers, at least one chelating agent, at least one co-solvent, optionally at least one ion-pairing reagent, and optionally at least one surfactant for combining with the dense fluid at the fab. Still another embodiment, the kit includes, in one or more containers, at least one chelating agent, at least one co-solvent, optionally at least one ion-pairing reagent, and optionally at least one surfactant for combining with the at least one co-solvent and dense fluid at the fab. The containers of the kit should be chemically rated to store and dispense the component(s) contained therein. The containers of the kit must be suitable for storing and shipping said liquid removal compositions, for example, NOWPak® containers (Advanced Technology Materials, Inc., Danbury, Conn., USA).

In yet another aspect, the invention relates to methods of removal of bulk and ion-implanted photoresist and/or post-etch residue from a densely patterned microelectronic device using the removal compositions described herein. For example, trench and via structures on the patterned devices may be cleaned while maintaining the structural integrity of the underlying silicon-containing layers, i.e., no substantial over-etching.

The dense fluid removal compositions of the present invention overcome the disadvantages of the prior art removal techniques by minimizing the volume of chemical reagents needed, thus reducing the quantity of waste, while simultaneously providing a composition and method having recyclable constituents, e.g., the SCFs. Both the liquid removal composition and the dense fluid removal composition of the invention effectively remove bulk and ion-implanted resist and/or post-etch residue without substantially over-etching the underlying silicon-containing layer(s) and metallic interconnect materials.

Once formulated, such removal compositions are applied to the densely patterned microelectronic device surface for contacting with the photoresist and/or residue material thereon.

The dense fluid removal compositions may be applied at suitable elevated pressures, e.g., in a pressurized contacting chamber to which the SCF-based composition is supplied at suitable volumetric rate and amount to effect the desired contacting operation, for at least partial removal of the resist and/or residue from the microelectronic device surface. The chamber may be a batch or single wafer chamber, for continuous, pulsed or static cleaning. The removal efficiency of the dense fluid removal compositions may be enhanced by use of elevated temperature and/or pressure conditions in the contacting of the bulk and ion-implanted resist and/or post-etch residue material to be removed with the dense fluid removal compositions.

The appropriate dense fluid removal compositions may be employed to contact a microelectronic device surface having resist thereon at a pressure in a range of from about 1,500 to about 4,500 psi, preferably in a range of from about 3,000 to about 4,500 psi, for sufficient time to effect the desired removal of the bulk and ion-implanted photoresist and/or post-etch residue, e.g., for a contacting time in a range of from about 1 minute to about 30 minutes and a temperature of from about 35° C. to about 75° C., preferably in a range of from about 60° C. to about 75° C., although greater or lesser contacting durations and temperatures may be advantageously employed in the broad practice of the present invention, where warranted. In a preferred embodiment, the contacting temperature and pressure is about 70° C. and about 3,800 psi, respectively, and the contacting time is about 10 minutes.

The removal process using the dense fluid compositions may include a static soak, a dynamic contacting mode, or sequential processing steps including dynamic flow of the dense fluid removal composition over the microelectronic device surface, followed by a static soak of the device in the dense fluid removal composition, with the respective dynamic flow and static soak steps being carried out alternatingly and repetitively, in a cycle of such alternating steps.

A "dynamic" contacting mode involves continuous flow of the composition over the device surface, to maximize the mass transfer gradient and effect complete removal of the resist and/or post-etch residue from the surface. A "static soak" contacting mode involves contacting the device surface with a static volume of the composition, and maintaining contact therewith for a continued (soaking) period of time.

The alternating dynamic flow/static soak steps may be carried out for successive cycles in the aforementioned illustrative embodiment, as including a sequence of 2.5 min-5 min dynamic flow, 2.5 min-5 min static soak, e.g., at about 3,800 psi, and 2.5 min-5 min dynamic flow.

It is to be appreciated by one skilled in the art that the contacting mode can be exclusively dynamic, exclusively static or any combination of dynamic and static steps needed to effectuate at least partial removal of the bulk and ion-implanted resist and/or post-etch residue from the microelectronic device surface.

Following the contacting of the dense fluid removal composition to the microelectronic device surface, the device thereafter preferably is rinsed, e.g., with aliquots of SCF/methanol (80%/20%) solution, to remove any residual precipitated chemical additives from the region of the device surface in which resist removal has been effected. Preferably, the rinse is effectuated at least three times. After the final rinse cycle is complete, the cleaning vessel may be rapidly depressurized, e.g., 0 psi over 5 seconds. The cleaning vessel may then re-charged with pure SCF at about 1,500 psi for approximately 1 minute to remove any residual methanol and/or precipitated chemical additives from the device surface and subsequently depressurized to 0 psi. The re-charging/depressurizing with pure $CO_2$ is preferably carried out a total of three times. Preferably, the SCF used for washing is $SCCO_2$.

The liquid fluid removal compositions may be applied in any suitable manner to the surface of the microelectronic device having bulk and ion-implanted photoresist and/or post-etch residue material thereon, e.g., by spraying the removal composition on the surface of the device, by dipping (in a volume of the removal composition) of the device, by contacting the device with another material, e.g., a pad, or fibrous sorbent applicator element, that is saturated with the removal composition, by contacting the device including the material with a circulating removal composition, or by any other suitable means, manner or technique, by which the removal composition is brought into removal contact with the bulk and ion-implanted photoresist and/or post-etch residue material.

In use of the liquid removal compositions of the invention for removing bulk and ion-implanted photoresist and/or post-etch residue from microelectronic device structures having same thereon, the liquid removal composition typically is contacted with the microelectronic device structure for a time of from about 30 seconds to about 45 minutes, preferably about 1 to 30 minutes, at a temperature in a range of from about 20° C. to about 100° C., preferably about 40° C. to about 60° C. Such contacting times and temperatures are illustrative, and any other suitable time and temperature conditions may be employed that are efficacious to substantially remove the bulk and ion-implanted photoresist and/or post-etch residue from the device structure.

Following the achievement of the desired removal action, the liquid removal composition is readily removed from the microelectronic device to which it has previously been applied, e.g., by rinse, wash, or other removal step(s), as may be desired and efficacious in a given end use application of the compositions of the present invention. For example, the microelectronic device may be rinsed with deionized water and dried using nitrogen.

It will be appreciated that specific contacting conditions for the removal compositions of the invention are readily determinable within the skill of the art, based on the disclosure herein, and that the specific proportions of ingredients and concentrations of ingredients in the compositions of the invention may be widely varied while achieving desired removal of the photoresist and/or post-etch residue material from the electronic device surface.

It is within the scope of the present invention that the liquid removal compositions may be used to remove photoresist, post-CMP residues, and/or BARC layers from the surface of a microelectronic device. In addition, the liquid removal compositions of the present invention may be used to remove contaminating materials from photomask materials for re-use thereof. As used herein, "post-CMP residue" corresponds to particles from the polishing slurry, carbon-rich particles, polishing pad particles, brush deloading particles, equipment materials of construction particles, copper, copper oxides, and any other materials that are the by-products of the CMP process.

Yet another aspect of the invention relates to the improved microelectronic devices made according to the methods of the invention and to products containing such microelectronic devices.

A still further aspect of the invention relates to methods of manufacturing an article comprising a microelectronic device, said method comprising contacting the microelectronic device with a liquid removal composition for sufficient time to at least partially remove bulk and ion-implanted photoresist and/or post-etch photoresist material from the microelectronic device having said material thereon, and incorporating said microelectronic device into said article, wherein the liquid removal composition includes at least one co-solvent, at least one chelating agent, optionally at least one ion pairing agent, and optionally at least one surfactant.

Another aspect of the invention relates to methods of manufacturing an article comprising a microelectronic device, said method comprising contacting the microelectronic device with a dense fluid removal composition for sufficient time to at least partially remove bulk and ion-implanted photoresist and/or post-etch photoresist material from the microelectronic device having said material thereon, and incorporating said microelectronic device into said article, wherein the dense fluid removal composition includes a dense fluid, preferably $SCCO_2$, at least one co-solvent, at least one chelating agent, optionally at least one ion pairing agent, and optionally at least one surfactant.

The features and advantages of the invention are more fully shown by the illustrative example discussed below.

EXAMPLE 1

Dilute chelating agent (Lewis base/HF adducts) (0.4 g) was combined with 40 mL of a co-solvent to form compositions having a 1 w/v % of fluoride source for etch rate studies. The dilute Lewis base/HF adducts were prepared as follows. Commercially available Lewis base/HF adducts, specifically pyridine/HF (1:9) and triethylamine/HF (1:3), were diluted to 1:3, 1:1 and 3:1 (mol:mol) using the same Lewis base. To make pyridine/HF (1:3), 52 wt. % of pyridine/HF (1:9) and 48 wt. % anhydrous pyridine were combined. To make pyridine/HF (1:1), 27 wt. % of pyridine/HF (1:9) and 73 wt. % anhydrous pyridine were combined. To make pyridine/HF (3:1), 11 wt. % of pyridine/HF (1:9) and 89 wt. % anhydrous pyridine were combined. To make triethylamine/HF (1:1), 71 wt. % of triethylamine/HF (1:3) and 29 wt. % anhydrous triethylamine were combined. To make triethylamine/HF (3:1), 44 wt. % of triethylamine/HF (1:3) and 56 wt. % anhydrous triethylamine were combined. With dilute triethylamine/HF (1:3) solutions, to prevent the precipitation of solid upon dilution of the commercial triethylamine/HF (1:3) solution with triethylamine, the commercial stock solution was diluted with both triethylamine and another solvent, e.g., methanol.

Etch rate studies were performed by immersing blanket wafers of silicon-containing material (Black Diamond 2, TEOS, thermal oxide, silicon nitride, and polysilicon) in the removal composition at 50° C. for up to 10 minutes. The co-solvents investigated were methanol, ethyl acetate, DMSO, and water. The etch rate of the silicon-containing material was determined by Nanospec and the results reported in Table 1 hereinbelow.

TABLE 1

Etch rates of Black Diamond2, thermal oxide, TEOS, silicon nitride and polysilicon in a liquid removal composition of the invention at 50° C. for 2 minutes.

| Wafer material | chelating agent | etch rate in methanol at t = 2 min/ Å $min^{-1}$ | etch rate in ethyl acetate at t = 2 min/ Å $min^{-1}$ | etch rate in water at t = 2 min/ Å $min^{-1}$ | etch rate in DMSO at t = 2 min/ Å $min^{-1}$ |
|---|---|---|---|---|---|
| Black Diamond2 | pyr/HF (1:9) | 54 | 559 | 43 | 0 |
| | pyr/HF (3:1) | 34 | 206 | 28 | 0 |
| | pyr/HF (1:1) | 15 | 140 | 5 | 0 |
| | pyr/HF (1:3) | 5 | 71 | 0 | 0 |
| | trieth/HF (3:1) | 0 | 34 | 17 | 10 |

TABLE 1-continued

Etch rates of Black Diamond2, thermal oxide, TEOS, silicon nitride and polysilicon in a liquid removal composition of the invention at 50° C. for 2 minutes.

| Wafer material | chelating agent | etch rate in methanol at t = 2 min/ Å $min^{-1}$ | etch rate in ethyl acetate at t = 2 min/ Å $min^{-1}$ | etch rate in water at t = 2 min/ Å $min^{-1}$ | etch rate in DMSO at t = 2 min/ Å $min^{-1}$ |
|---|---|---|---|---|---|
| | trieth/HF (1:1) | 0 | 27 | 10 | 4 |
| | trieth/HF (1:3) | 0 | 17 | 0 | 0 |
| thermal oxide | pyr/HF (1:9) | 51 | 328 | 255 | 0 |
| | pyr/HF (3:1) | 45 | 227 | 85 | 0 |
| | pyr/HF (1:1) | 31 | 200 | 10 | 0 |
| | pyr/HF (1:3) | 17 | 155 | 7 | 0 |
| | trieth/HF (3:1) | 32 | 53 | 101 | 12 |
| | trieth/HF (1:1) | 20 | 42 | 40 | 0 |
| | trieth/HF (1:3) | 4 | 37 | 11 | 0 |
| TEOS | pyr/HF (1:9) | 388 | 468 | 690 | 6 |
| | pyr/HF (3:1) | 207 | 249 | 292 | 7 |
| | pyr/HF (1:1) | 95 | 265 | 33 | 0 |
| | pyr/HF (1:3) | 44 | 238 | 16 | 0 |
| | trieth/HF (3:1) | 70 | 156 | 268 | 22 |
| | trieth/HF (1:1) | 65 | 94 | 225 | 18 |
| | trieth/HF (1:3) | 4 | 73 | 17 | 15 |
| $Si_3N_4$ | pyr/HF (1:9) | 168 | 376 | 489 | 0 |
| | pyr/HF (3:1) | 43 | 221 | 196 | 2 |
| | pyr/HF (1:1) | 27 | 219 | 32 | 0 |
| | pyr/HF (1:3) | 14 | 52 | 0 | 0 |
| | trieth/HF (3:1) | 31 | 74 | 207 | 12 |
| | trieth/HF (1:1) | 26 | 46 | 131 | 11 |
| | trieth/HF (1:3) | 7 | 40 | 26 | 10 |
| poly-Si | pyr/HF (1:9) | 16 | 21 | 10 | 0 |
| | pyr/HF (3:1) | 10 | 13 | 13 | 0 |
| | pyr/HF (1:1) | 6 | 8 | 2 | 0 |
| | pyr/HF (1:3) | 4 | 7 | 0 | 0 |
| | trieth/HF (3:1) | 10 | 37 | 11 | 0 |
| | trieth/HF (1:1) | 10 | 43 | 6 | 0 |
| | trieth/HF (1:3) | 0 | 45 | 0 | 0 |

Referring to Table 1, it can be seen that the pyridine/HF solutions etch the studied silicon-containing materials (Black Diamond2, TEOS, thermal oxide, silicon nitride, and polysilicon) faster than the triethylamine/HF solutions. Acidity and a high $[HF_2^-]$ concentration are essential to etching silicon-containing materials. As a result, the etch rates increase in the presence of the pyridine/HF solutions because pyridine ($pK_a$ in water=5) is a stronger acid than triethylamine ($pK_a$ in water=11). Commercially available pyridine/HF (1:9) has an extremely high etch rate compared to the dilute solutions studied. Consequently, the dilute solutions have a more substantial potential of selectively removing photoresist, ion-implanted photoresist, and post-etch residue materials relative to the underlying low-k dielectric, hard mask, and silicon-containing layers.

Co-solvent also plays a role in the etching of the silicon-containing materials. Referring to Table 1, the etch rates were found to increase on the order DMSO<<water~methanol<ethyl acetate. Another trend of the dilute anhydrous amine/HF (mol/mol) solutions is that the etch rate of the materials increase on the order 1:3<1:1<3:1. This is probably due to the increased deprotonation of the HF with increasing anhydrous amine concentrations.

Figure 2:
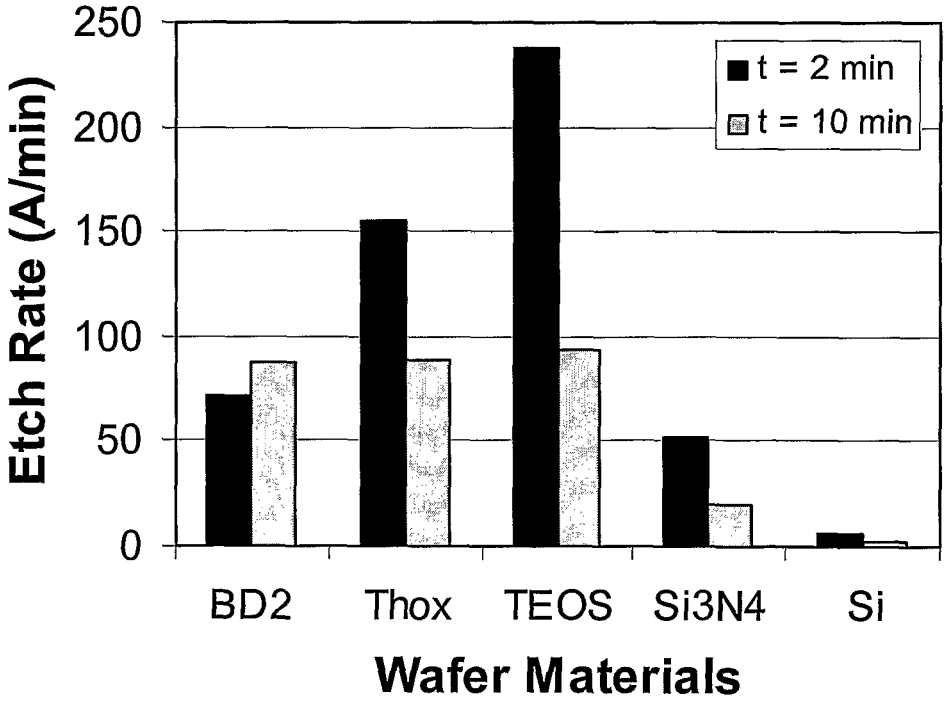
FIG. 2 is an illustration of the selectivity of TEOS and thermal oxide (Thox) relative to Black Diamond 2 (BD2), $Si_3N_4$ and polysilicon, following immersion of each in a 1 w/v % pyridine/HF (1:3) in ethyl acetate composition at 50° C.
Figure 3:
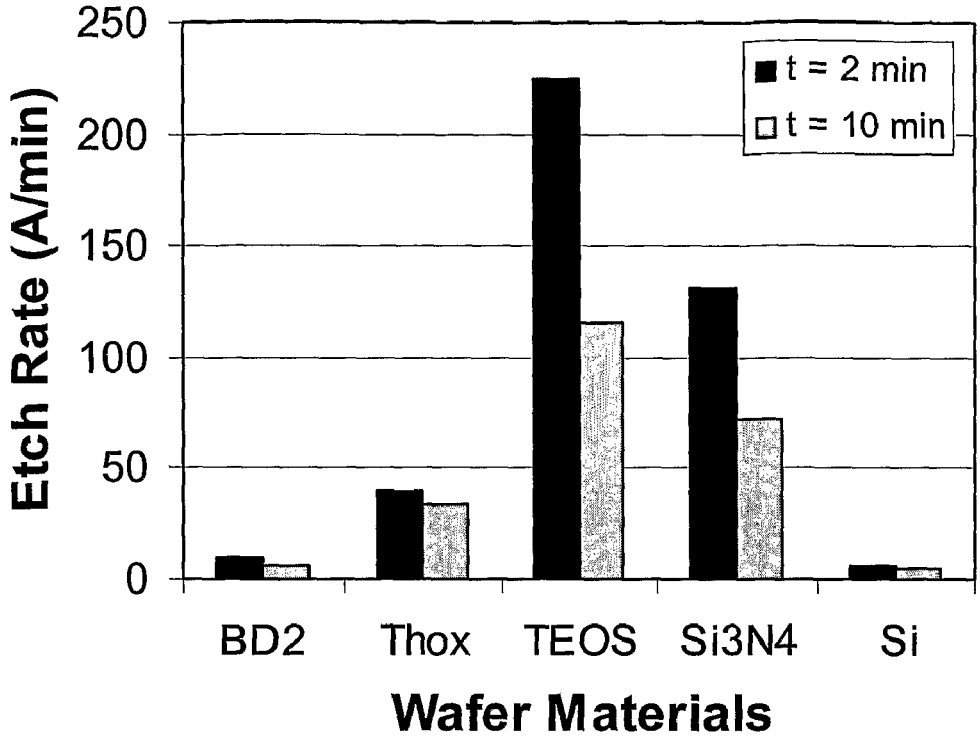
FIG. 3 is an illustration of the selectivity of TEOS and silicon nitride relative to Black Diamond 2 (BD2), thermal oxide (Thox) and polysilicon, following immersion of each in a 1 w/v % triethylamine/HF (1:1) in water composition at 50° C.
Figure 4:
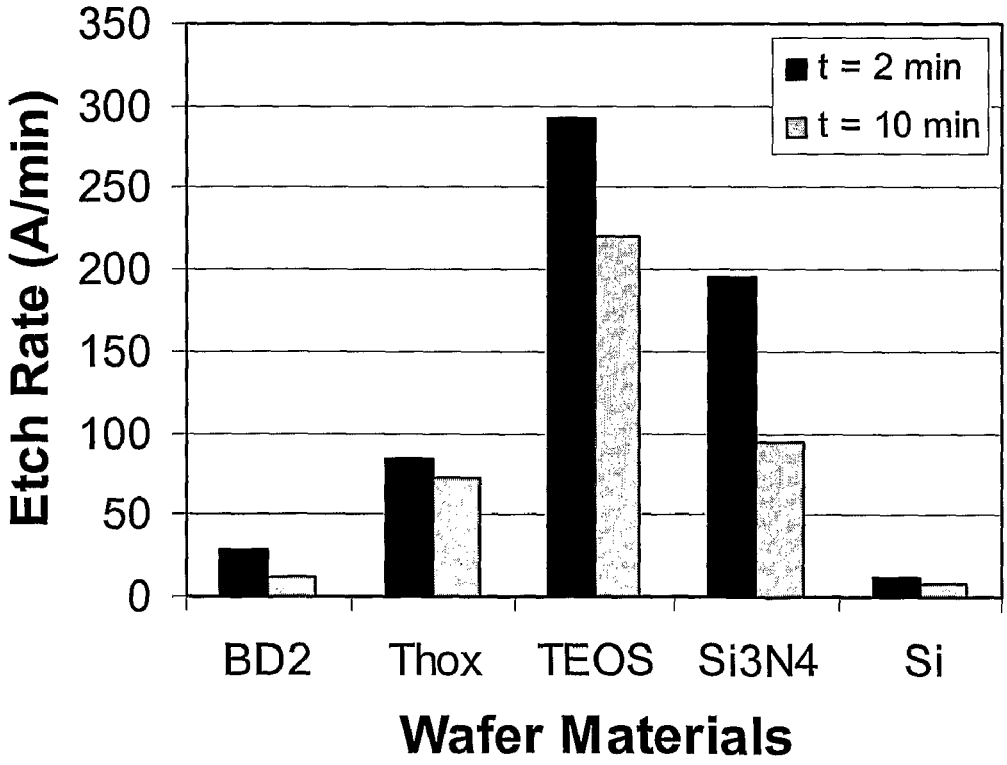
FIG. 4 is an illustration of the selectivity of TEOS and silicon nitride relative to Black Diamond 2 (BD2), thermal oxide (Thox) and polysilicon, following immersion of each in a 1 w/v % pyridine/HF (3:1) in water composition at 50° C.

In addition, selective etching of one silicon-containing material relative to another was observed, depending on the dilute amine/HF ratio. For example, FIG. 1 shows that TEOS can be dissolved with good selectivity over the others using the pyridine/HF (1:1) solution in methanol. FIG. 2 shows that thermal oxide and TEOS can be dissolved with good selectivity over the others using the pyridine/HF (1:3) solution in ethyl acetate. FIGS. 3 and 4 show that silicon nitride and TEOS can be dissolved with good selectivity over the others using the triethylamine/HF (1:1) solution or pyridine/HF (3:1) solution in water.

EXAMPLE 2

Figure 5B:
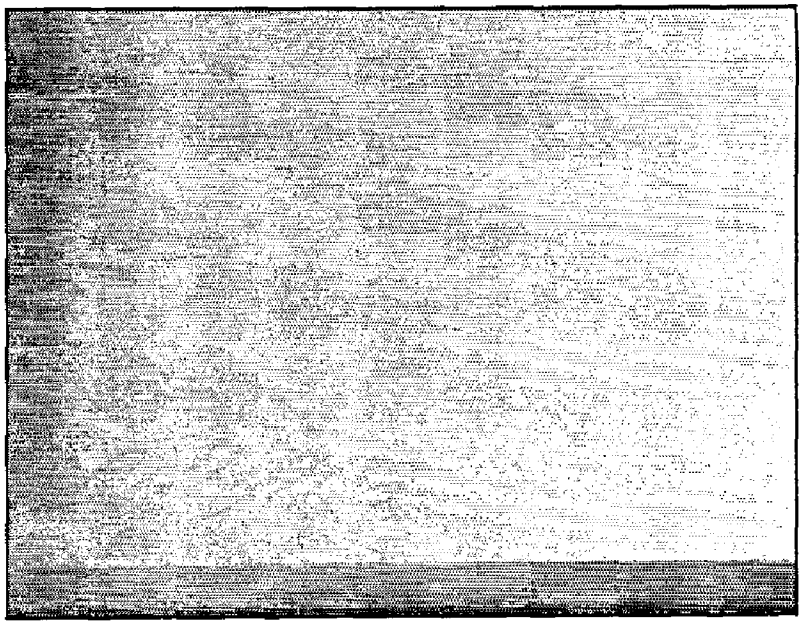
FIG. 5B is a scanning electron micrograph (60° angle view) of the densely patterned substrate of FIG. 5A after processing with the dense fluid removal composition of the present invention.
Figure 5A:
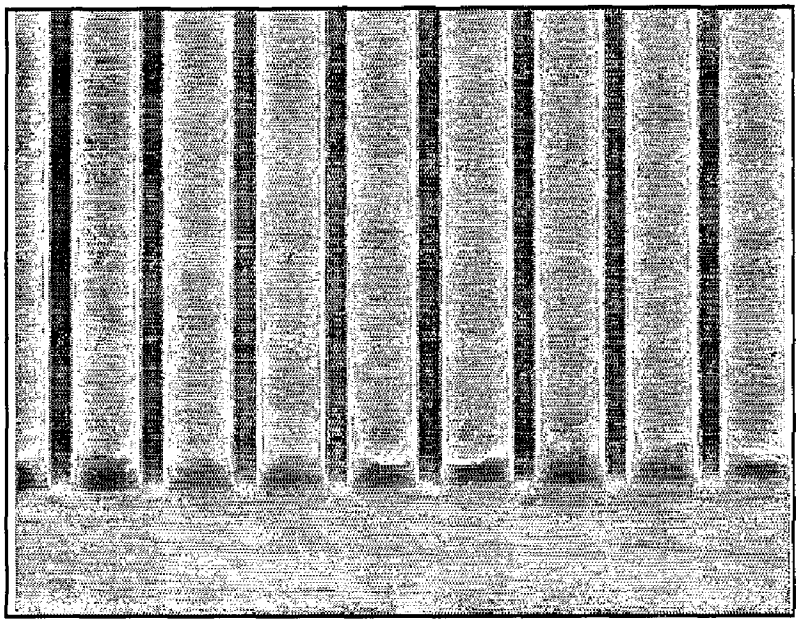
FIG. 5A is a scanning electron micrograph (60° angle view) of a densely patterned substrate having ion-implanted photoresist thereon before processing.

The sample wafer examined in this study was a patterned silicon wafer including bulk and ion-implanted photoresist layers (see FIG. 5A). Various chemical additives, as described herein, were added to the dense fluid removal composition and removal efficiency of said composition evaluated. The dense fluid removal composition included 98.95 wt. % $SCCO_2$, 1 wt % methanol, and 0.05 wt. % pyridine/HF complex (1:1 mole ratio). The temperature of the SCF-based composition was maintained at 70° C. throughout the removal experiments. The removal conditions included a static soak at 3,800 psi for 10 minutes described hereinabove. Following removal, the wafer was thoroughly rinsed first with copious amounts of $SCCO_2$/methanol and then with copious amounts of pure $SCCO_2$, as described herein, in order to remove any residual solvent and/or precipitated chemical additives. FIG. 5B shows the result of this experiment, as described herein below.

FIG. 5A is a scanning electron micrograph (60° angle view) of a densely patterned substrate having ion-implanted photoresist thereon before processing.

FIG. 5B is a scanning electron micrograph (60° angle view) of the densely patterned substrate of FIG. 5A after processing with the dense fluid removal composition of the present invention. The micrographs illustrate that the carbonized photoresist crust was completely removed without substantially over-etching the underlying low-k dielectric material The above-described micrographs thus evidence the efficacy of dense fluid removal compositions in accordance with the invention, for removal of ion-implanted photoresist from microelectronic device surfaces. Accordingly, while the invention has been described herein in reference to specific aspects, features and illustrative embodiments of the invention, it will be appreciated that the utility of the invention is not thus limited, but rather extends to and encompasses numerous other aspects, features and embodiments. Accordingly, the claims hereafter set forth are intended to be correspondingly broadly construed, as including all such aspects, features and embodiments, within their spirit and scope.

What is claimed is:

1. A method of removing bulk and ion-implanted photoresist and/or post-etch residue material from a microelectronic device having said material thereon, said method comprising contacting the microelectronic device with a removal composition for sufficient time to at least partially remove said material from the microelectronic device, wherein the removal composition includes at least one co-solvent, at least one chelating agent, at least one ion pairing agent selected from the group consisting of pyrrolidinecarbodithiolate salt, trifluoromethanesulfonate salt, trifluoroethyl dithiocarbamate salt, cetyl tetramethylammonium sulfuric acid, cetyl tetramethylammonium bromide, hexadecylpyridinium chloride, tetrabutylammonium bromide, dioctylsulfosuccinate salt, 2,3-dimercapto-1-propanesulfonic acid salt, and combinations thereof, and optionally at least one surfactant.

2. The method of claim 1, wherein the co-solvent comprises at least one solvent selected from the group consisting of: water; methanol; ethanol; isopropanol; ethers; N-methylpyrrolidones; N-octyl-pyrrolidones; N-phenyl-pyrrolidones; sulfolane; ethyl acetate; alkanes; alkenes; at least partially fluorinated hydrocarbons; amines; phenols; tetrahydrofuran; toluene; xylene; cyclohexane; acetone; dioxane; dimethyl formamide; dimethylsulfoxide; pyridine; triethylamine; acetonitrile; glycols; butyl carbitol; methyl carbitol, hexyl carbitol, monoethanolamine; butyrol lactone; diglycol amine; tetramethylene sulfone; diethyl ether; ethyl lactate; ethyl benzoate; ethylene glycol; dioxane; pyridine; γ-butyrolactone; butylene carbonate; ethylene carbonate; propylene carbonate; and mixtures thereof; and wherein the chelating agent comprises a chelant species selected from the group consisting of 1,1,1,5,5,5-hexafluoro -2,4-pentanedione (hfacH), 1,1,1-trifluoro -2,4-pentanedione (tfacH), 2,2,6,6-tetramethyl-3,5-heptanedione (tmhdH), acetylacetone (acacH), pyridine, 2-ethylpyridine, 2-methoxypyridine, 2-picoline, pyridine derivatives, piperidine, piperazine, triethanolamine, diglycol amine, monoethanolamine, pyrrole, isoxazole, 1,2,4-triazole, bipyridine, pyrimidine, pyrazine, pyridazine, quinoline, isoquinoline, indole, and imidazole, triethylamine, ammonia, oxalate, acetic acid, formic acid, sulfuric acid, citric acid, phosphoric acid, butyl acetate, perfluorobutanesulfonyl fluoride, pyrrolidinecarbodithiolate, diethyldithiocarbamate, trifluoroethyl dithiocarbamate, trifluoromethanesulfonate, methanesulfonic acid, meso-2,3-dimercaptosuccinic acid, 2,3-dimercapto-1-propanesulfonic acid, 2,3-dimercapto-1-propanol, 2-methylthio-2-thiazoline, 1,3-dithiolane, sulfolane, perfluorodecanethiol, 1,4,7-trithiacyclononane, 1,4,8,11-tetrathiacyclotetradecane, 1,5,9,13-tetraselenacyclohexadecane, 1,5,9,13,17,21-hexaselenacyclotetracosane, iodine, bromine, chlorine, triphenylphosphine, diphenyl(pentafluorophenyl)phosphine, bis(pentafluorophenyl)phenylphosphine, tris (pentafluorophenyl)phosphine, tris(4-fluorophenyl) phosphine, 1,2-bis [bis(pentafluorophenyl)phosphino] ethane, 1,2-bis(diphenylphosphino)ethane, pyridine/HF complex, pyridine/HCl complex, pyridine/HBr complex, triethylamine/HF complex, triethylamine/HCl complex, monoethanolamine/HF complex, triethanolamine/HF complex, triethylamine/formic acid complex, and combinations thereof.

3. The method of claim 1, wherein the contacting comprises conditions selected from the group consisting of: temperature in a range from about 40° C. to about 60° C.; time in a range of from about 1 minute to about 30 minutes; and combinations thereof.

4. The method of claim 1, wherein the removal composition further comprises dense fluid.

5. The method of claim 4, wherein the contacting comprises conditions selected from the group consisting of: pressure in a range of from about 1500 to about 4,500 psi; time in a range of from about 1 minute to about 30 minutes; temperature in a range from about 40° C. to about 75° C.; and combinations thereof.

6. The method of claim 1, wherein the chelating agent is complexed with at least one dopant ion selected from the group consisting of an arsenic ion, a boron ion, a phosphorous ion, an indium ion, and an antimony ion.

7. The method of claim 1, wherein the contacting the microelectronic device with the removal composition comprises forming dopant ion/chelating agent complexes between dopant ions in the ion-implanted photoresist and the chelating agents.

8. The method of claim 7, wherein the ion pairing agent solubilizes the dopant ion/chelating agent complexes.

9. The method of claim 1, wherein the removal composition comprises, supercritical carbon dioxide methanol and pyridine:HF.

10. The method of claim 1, wherein the removal composition comprises methanol, pyridine, pyridine:HF, and at least one acetylenic diol surfactant.

11. The method of claim 1, wherein the co-solvent comprises a species selected from the group consisting of methanol, water, and dimethylsulfoxide.

12. The method of claim 1, wherein the chelating agent comprises a species selected from the group consisting of pyridine/HF and triethylamine/HF complex.

13. The method of claim 4, wherein the dense fluid comprises a species selected from the group consisting of Ar, $NH_3$, $N_2$, $CH_4$, $C_2H_4$, $CHF_3$, $C_2H_6$, n-$C_3H_8$, $H_2O$, and $N_2O$.

14. The method of claim 1, wherein the removal composition that selectively removes ion-implanted photoresist relative to the underlying $Si/SiO_2$ layers.

15. The method of claim 1, comprising surfactant, wherein the surfactant comprises a species selected from the group consisting of fluoroalkyl surfactants, ethoxylates of 2,4,7,9-Tetramethyl-5-decyne-4,7-diol, alkyl aryl polyethers, fluorosurfactants, dioctylsulfosuccinate salt, 2,3-dimercapto-l-propanesulfonic acid salt, dodecylbenzenesulfonic acid, amphiphilic fluoropolymers, dinonylphenyl polyoxyethylene, silicone polymers, modified silicone polymers, acetylenic diols, modified acetylenic diols, alkylammonium salts, modified alkylammonium salts, sodium dodecyl sulfate, aerosol-OT (AOT) and fluorinated analogues thereof, alkyl ammonium, perfluoropolyether surfactants, 2-sulfosuccinate salts, phosphate-based surfactants, sulfur-based surfactants, and acetoacetate based polymers.

* * * * *